US006749366B1

(12) United States Patent
Chinn et al.

(10) Patent No.: US 6,749,366 B1
(45) Date of Patent: Jun. 15, 2004

(54) ENVIRONMENTAL FILTER AND FLOW CONTROL DEVICE

(75) Inventors: Andrew W. Chinn, Grove City, OH (US); Geralde M. Chinn, Columbus, OH (US)

(73) Assignee: Dandy Products, Inc., Dublin, OH (US)

( * ) Notice: Subject to any disclaimer, the term of this patent is extended or adjusted under 35 U.S.C. 154(b) by 129 days.

(21) Appl. No.: 10/082,374

(22) Filed: Feb. 25, 2002

(51) Int. Cl.[7] ..... E03F 5/14; B01D 35/28

(52) U.S. Cl. ..... 405/41; 405/40; 210/164; 210/315; 404/4

(58) Field of Search ..... 405/36, 39, 40, 405/41, 42, 48, 124–127; 404/2, 4, 5; 210/163, 164, 165, 170, 747, 294, 295, 315, 484, 473, 471, 459, 460

(56) References Cited

U.S. PATENT DOCUMENTS 5,345,741 A * 9/1994 Slater et al. ..... 405/36
5,372,714 A * 12/1994 Logue, Jr. ..... 404/4
6,004,457 A * 12/1999 Singleton ..... 405/41
6,010,622 A * 1/2000 Chinn et al. ..... 404/4
6,261,445 B1 * 7/2001 Singleton ..... 405/41
6,274,036 B1 * 8/2001 Ellis ..... 210/164
6,428,693 B2 * 8/2002 Singleton ..... 405/41

* cited by examiner

*Primary Examiner*—Frederick L. Lagman
(74) *Attorney, Agent, or Firm*—James R. Eley; Michael A. Forhan; Thompson Hine LLP

(57) ABSTRACT

The present invention relates generally to a system for use in filtering a variety of environmental substances, and more particularly to a method and apparatus for filtering such substances as soil, sediment, and debris from such things as water runoff that may be entering storm drains or catch basins for example. The filter may be comprised of a base and a readily visible top portion. A storm sewer grate may then be inserted within the filter and placed in an opening of the inlet. Water may then be filtered, through either or both the top portion and/or through the base, before entering the inlet. The top portion functions as a visual aid, thereby allowing workers, inspectors and equipment operators to easily locate the storm sewer grate.

20 Claims, 6 Drawing Sheets

ENVIRONMENTAL FILTER AND FLOW CONTROL DEVICE

BACKGROUND AND SUMMARY OF THE INVENTION

The present invention relates generally to a system for use in filtering a variety of environmental substances, and more particularly to a method and apparatus for filtering such substances as soil, sediment, and debris from such things as water runoff that may be entering storm drains or catch basins for example.

In recent years, state, federal and local governments have placed controls on sources of pollution and on circumstances that may lead to erosion of an environmentally protected substance. One source of water pollution is called runoff. Runoff can include dust and other particulates from roads, leaves from trees, top soil, grass cuttings from lawns and parks and fallout from air pollution. Runoff can be particularly problematic when the source of water is from an area of ground which has been disturbed or broken up, such as may be found at construction sites. Runoff from these areas may contain a high amount of soil and debris. Additionally, runoff caused by a storm may be particularly heavy and dynamic and therefore may carry a great deal of particulates in a short period of time. During a storm the rate of storm water runoff can be several times the normal flow. Various methods have been developed in an attempt to minimize the adverse effects of runoff.

Even though various method have been developed in an attempt to minimize the adverse effects of runoff, other problems have been created. One of these problems is the inability for inspectors, workers and equipment operators to locate filters and storm sewer grates. Due to the grates being substantially level with the ground, some grates can be inadvertently overlooked, causing missed inspections or grates to be covered as the ground is bulldozed or landscaped by equipment operators.

The present invention is designed to provide an easy to install and maintain environmental filter system. The present invention includes a filter. The filter is proportioned to receive an inlet device such as a storm sewer grate. The filter may be of various sizes to accept inlet devices of varying size. The present invention may comprise porous fabric that may be stitched, glued, welded, riveted, or otherwise formed into an enclosure to house an inlet device. "Porous" as used herein means that the fabric has holes that may range in size from microscopic up to an inch or more in diameter. "Fabric" as used herein means any material suitable for this purpose, including but not limited to geotextile material, plastic mesh material, cloth material, etc. In an embodiment of the present invention, the top portion of the filter, which remains above the grate when in use, may rise several inches or feet above ground level to be easily visible and may be shaped or made to form a wide variety of shapes such as dome-shaped or tent-shaped. The dome-shaped or tent-shaped top portion allows the present invention to be easily visible to inspectors, workers and equipment operators so that the grate or filtering device is not inadvertently overlooked. The dome-shaped top portion may also be adapted to prevent silt, rocks, debris, etc. from entering the inlet.

For example, a storm sewer grate may be placed within the present invention and then positioned on the catch basin in its customary location. The present invention may prohibit soil, rubble, stones, or debris from entering the sewer. The present invention avoids the necessity of removing soil, silt, stones and other particulate matter from within the sewer and thus avoids the expense and cost associated with such filters.

Additionally, the present invention may act as a double filter for the runoff. The present invention may surround or substantially cover the inlet device and is preferably located both above and below the inlet device. For example, water entering a sewer grate may be filtered both by the fabric located above the grate and by the fabric located below the grate as the grate resides inside the enclosure formed by the fabric. The filter of the present invention may function in part similarly as taught by U.S. Pat. Nos. 5,725,782 and 6,010,622, the disclosures of which are hereby incorporated by reference herein.

Maintenance and cleaning of the present invention may involve periodic removal of particulate matter that may build up on the inlet device. Removal of the present invention may involve lifting the inlet device (grate, for example) and removing the device from the present invention. Alternatively, the apparatus of the present invention may be cleaned or another may be used again to receive the inlet device such as a sewer grate, and be installed onto the inlet, such as a catch basin.

The top portion of the present invention allows the filter device to be easily seen. However, the present invention may be foldable to a closed position. In this closed position, the present invention may be substantially flat in nature so that transportation and storage may be easily accomplished.

In addition to the novel features and advantages mentioned above, other objects and advantages of the present invention will be readily apparent from the following descriptions of the drawings and exemplary embodiments.

BRIEF DESCRIPTION OF THE DRAWINGS

Referring to the drawings:

FIG. 4(*b*) is a perspective view of the embodiment of FIG. 1, showing a storm sewer grate being inserted into the opening of the filter.

DETAILED DESCRIPTION OF THE PREFERRED EMBODIMENT(S)

The present invention relates generally to a system for use in filtering a variety of environmental substances, and more particularly to a method and apparatus for filtering such substances as soil, sediment, and debris from such things as water runoff that may be entering storm drains or catch basins, while being easily visible to workers, inspectors and equipment operators. "Sediment" as used herein means earth and rock material transported by wind and/or water, and has no size limitations.

Figure 1:
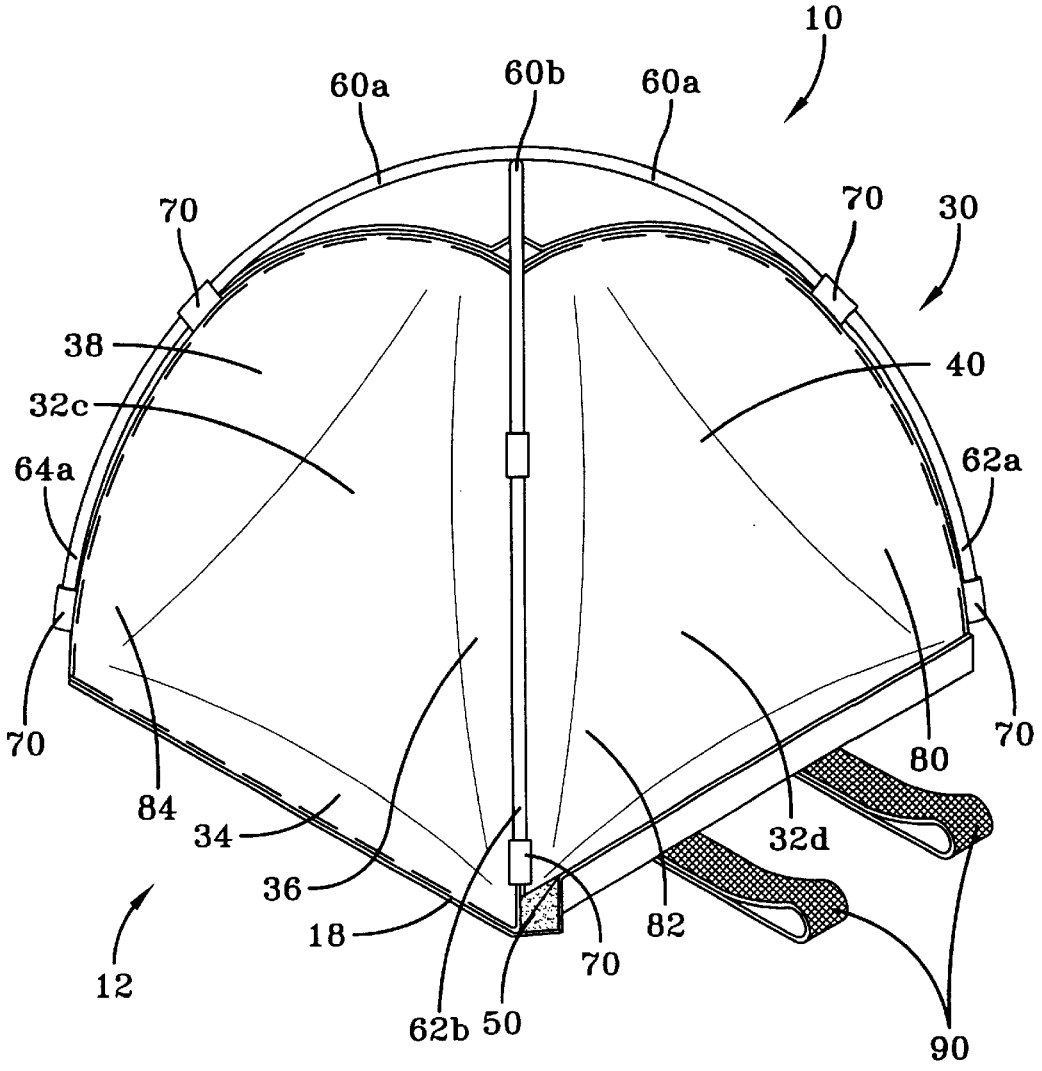
FIG. 1 is a perspective view of an exemplary embodiment of the filter of the present invention.

The apparatus 10 of the present invention may be seen in FIG. 1. The apparatus 10 may comprise a water permeable fabric or composition of fabrics or other suitable material conducive to filtering out debris, soil and sediments, while allowing water to pass through the apparatus 10. In an exemplary embodiment, the apparatus 10 has a dome-shaped top portion 30 which rises vertically above the grate and can be seen above the grate.

The apparatus 10 of the present invention may be comprised of a base 12 and a top portion 30. The base 12 may be practically any shape but more preferably substantially rectangle in shape, having a number of sides, preferably four sides—a first side 14, a second side 16, a third side 18 and a fourth side 20. The top portion 30 may be comprised of a number of walls 32. Each wall 32 may be practically any shape but more preferably substantially semi-elliptical in shape, thereby having a flat end 34 and a semi-elliptical end 36. In another embodiment of the present invention, the base 12 may be any suitable shape, and each wall 32 may be semicircular in shape or another geometric or even non-symmetric shape. Additionally, the apparatus 10 may have any suitable number of sides.

The flat end 34 of a first wall 32*a* may be stitched or otherwise secured to a first side 14 of the base 12. The flat end 34 of a second wall 32*b* may be stitched or otherwise secured to a second side 16 of the base 12. The flat end 34 of a third wall 32*c* may be stitched or otherwise secured to a third side 18 of the base 12. The flat end 34 of a fourth wall 32*d* is located similarly to the fourth side 20 of the base 12 as the other walls, but in this example is not permanently stitched to the base 12. When the apparatus 10 is completely constructed, this will allow for an opening whereby a grate may be inserted.

Each wall 32 is then stitched or otherwise secured to the adjacent wall 32. More particularly, the right side 36 of the semi-elliptical end 40 of the first wall 32*a* may be stitched or otherwise secured to the left side 38 of the semi-elliptical end 40 of the second wall 32*b*. The right side 36 of the semi-elliptical end 40 of the second wall 32*b* may be stitched or otherwise secured to the left side 38 of the semi-elliptical end 40 of the third wall 32*c*. The right side 36 of the semi-elliptical end 40 of the third wall 32*c* may be stitched or otherwise secured to the left side 38 of the semi-elliptical end 40 of the fourth wall 32*d*. The right side 36 of the semi-elliptical end 40 of the fourth wall 32*d* may then be stitched or otherwise secured to the left side 38 of the semi-elliptical end 40 of the first wall 32*a*, thereby defining the apparatus 10. Each wall 32 may act as a filter material or may act as a blocker or diverter as each use may indicate. In a single apparatus 10, one or more walls 32 may be filters while one or more other walls 32 may be blockers. If a filter wall is desired then a filter material would be used for that wall. If a blocker wall is desired then a blocking material would be used for that wall. A blocking material is a material that substantially prevents water from passing through it.

Figure 4A:
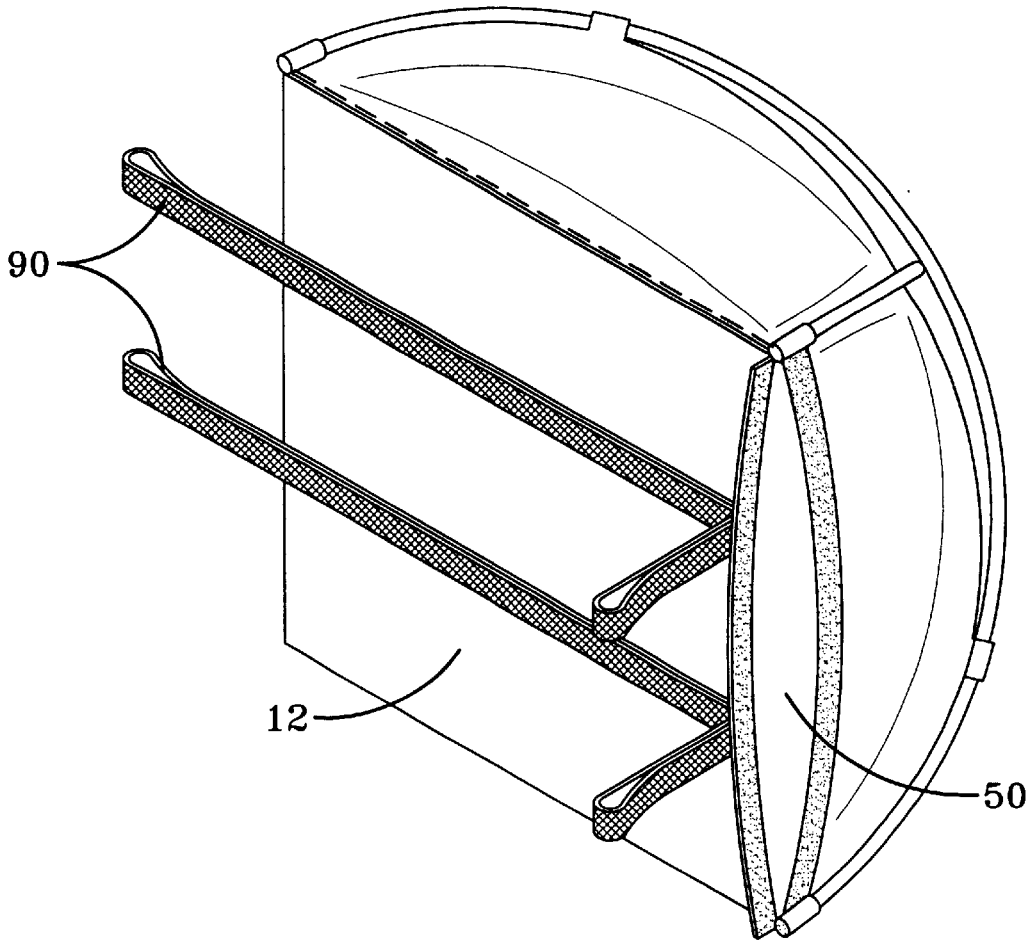
FIG. 4(*a*) is a perspective view of the embodiment of FIG. 1, showing the opening where a storm sewer grate may be inserted.
Figure 4B:
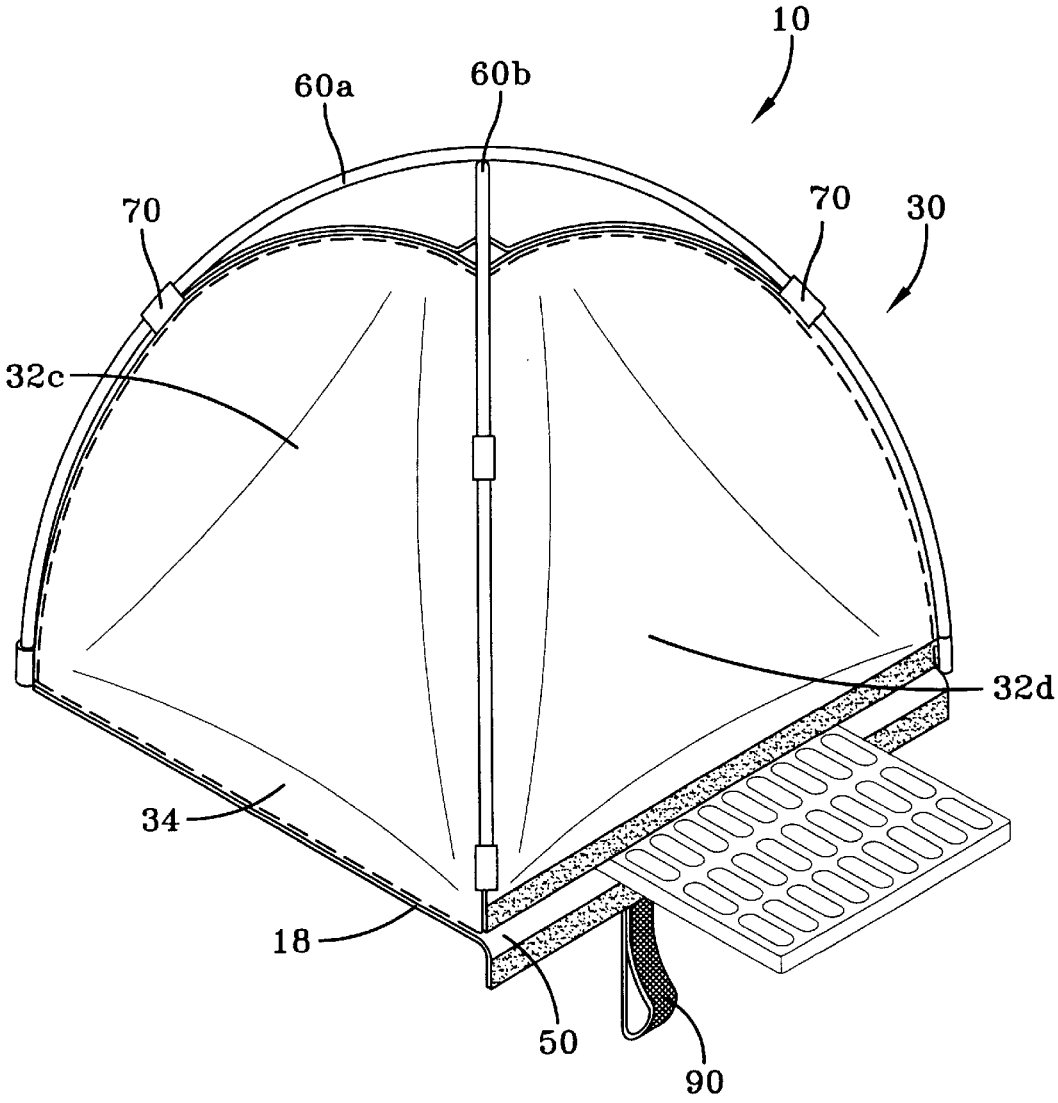

The apparatus 10 may have an opening 50 where a storm sewer grate may be inserted, as shown in FIG. 4. The opening 50 may contain Velcro or some other temporary closure so that the apparatus 10 may be easily opened, particularly to insert or remove a grate.

Figure 2:
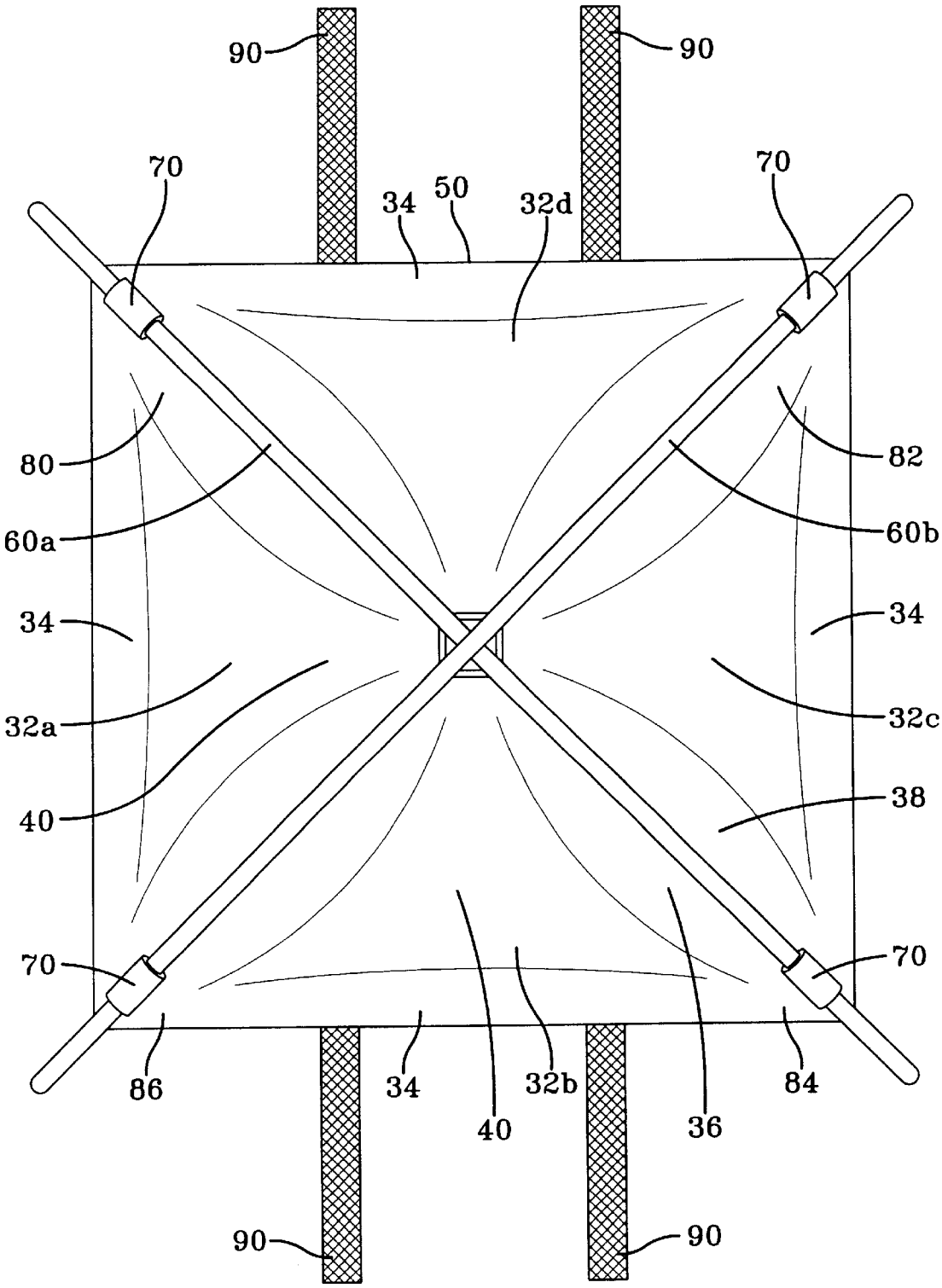
FIG. 2 is a top plan view of the embodiment of FIG. 1.

In one example of the present invention, the apparatus 10 maintains its dome-shaped, preferably with a number of forming rods 60*a*, 60*b*. The forming rods 60*a*, 60*b* may be preferably semi-circular in shape and attached to the dome-shaped top portion 30 by securing loops 70 or other conventional ways. Specifically, a first end 62*a* of a first forming rod 60*a* may be secured to a first corner 80 of the dome-shaped top portion 30 via a securing loop 70. A second end 64*a* of a first forming rod 60*a* may be secured to a third corner 84 of the dome-shaped top portion 30 via a securing loop 70. A first end 62*b* of a second forming rod 60*b* may be secured to a second corner 82 of the dome-shaped top portion 30 via a securing loop 70, while a second end 64*b* of a second forming rod 60*b* may be secured to a fourth corner 86 of the dome-shaped top portion 30 via a securing loop 70. The first forming rod 60*a* and the second forming rod 60*b* may intersect and be substantially perpendicular with regards to each other, as shown in FIG. 2.

Figure 3:
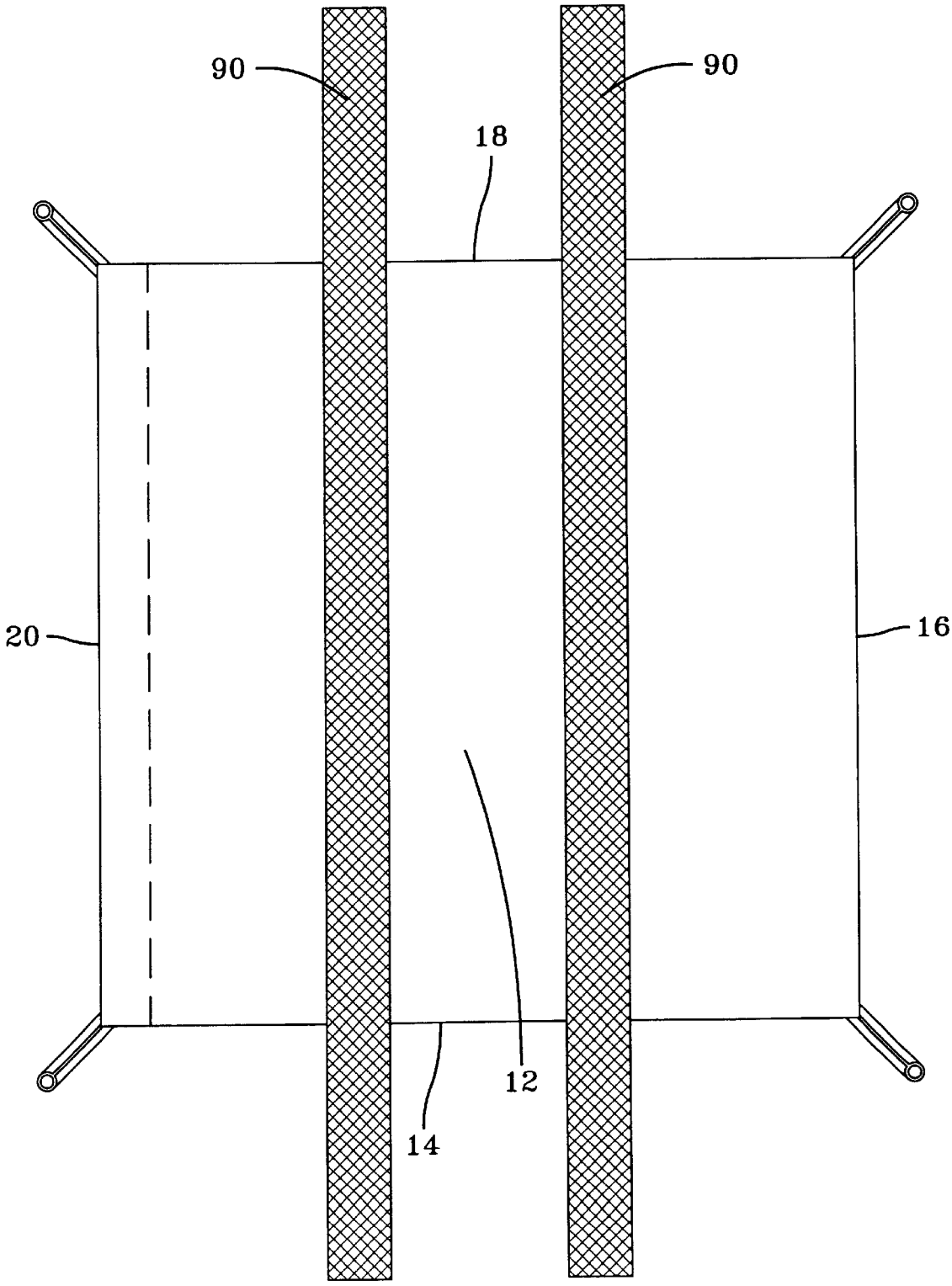
FIG. 3 is a bottom plan view of the embodiment of FIG. 1.

The apparatus 10 may also have at least one positioning strap 90 stitched or otherwise secured to the bottom of the base 12. In an exemplary embodiment of the apparatus 10 of the present invention, there may be two positioning straps 90, substantially parallel to each other, stitched or otherwise secured to the bottom of the base 12, as shown in FIG. 3. The positioning straps 90 may be used to aide in moving the apparatus 10 when a storm sewer grate has been inserted inside and is being positioned in the sewer inlet.

In order to operate and install the apparatus 10 of the present invention, a storm sewer grate may be inserted into the opening 50 of the apparatus 10. After a sewer grate has been enclosed within the apparatus 10, the sewer grate may be placed within a catch basin in its customary position. The apparatus 10 preferably encloses the sewer grate on both an upper surface and a lower surface. However, the filtering may also be accomplished principally above the grate with some or all of the lower surface open while enough of the top portion is pinched by the grate to hold it in place. As runoff flows into the catch basin, it may be filtered in this example by both the upper surface (dome-shaped top portion 30) and the lower surface (base 12) of the apparatus 10. This may effect a double filtering of the runoff that enters the catch basin. In addition to the dome-shaped top portion 30 filtering runoff, it also serves as a visual aid, thereby allowing workers, inspectors and equipment operators to easily view the location of the storm sewer grates. In yet another example, the lower surface may be the principal filter material while the top portion is primarily for visibility without necessarily filtering.

Figure 5:
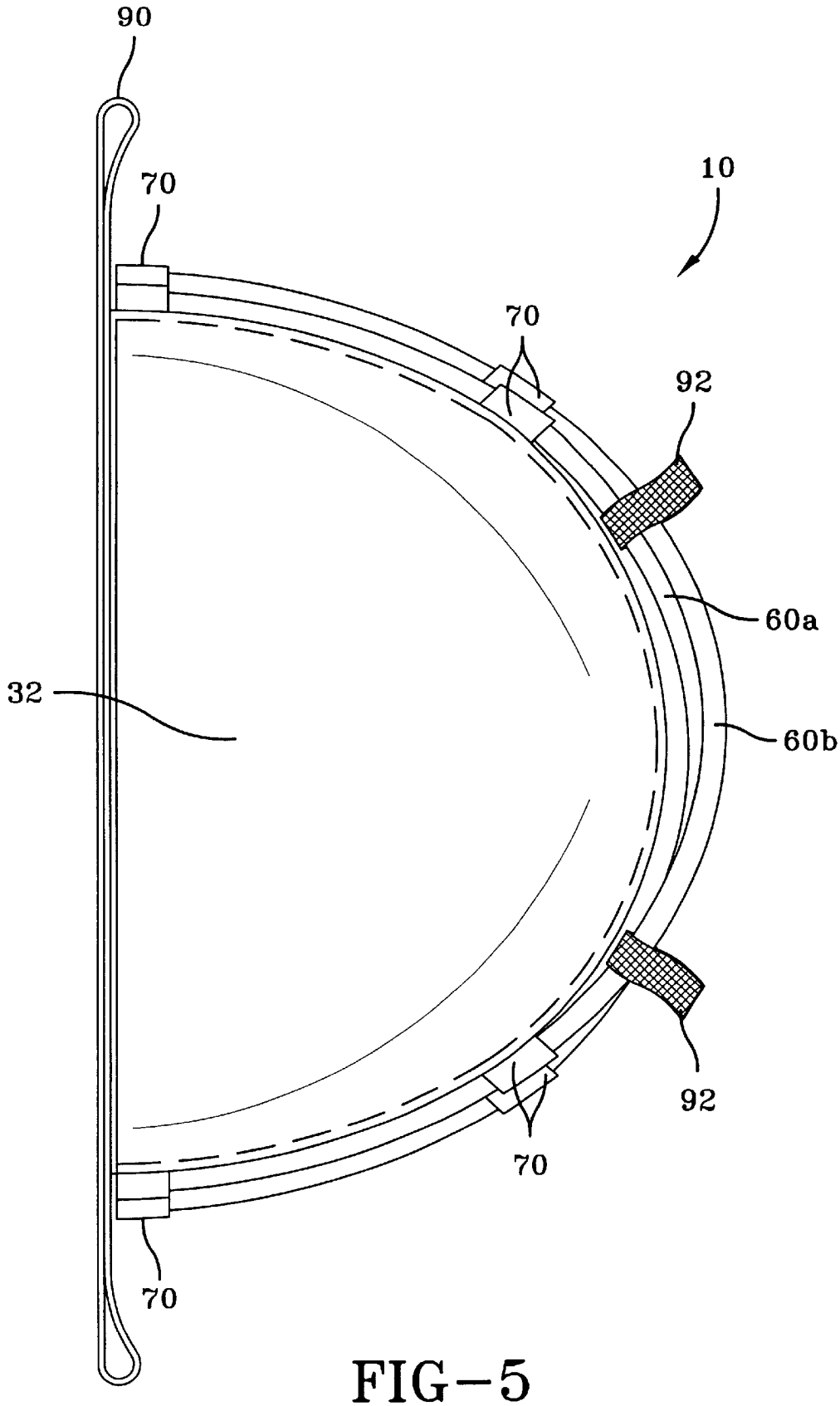
FIG. 5 is a perspective view of the embodiment of FIG. 1 when it is in its closed position.

When the apparatus 10 is not in use, the apparatus 10 may be flattened and closed, as shown in FIG. 5, for easy storage and transportation. The apparatus 10 may be held in the closed position by at least one, and preferably two, closing straps 92 secured around the forming rods 60*a*, 60*b*, thereby securing them in close proximity to each other.

The present invention may be constructed of various materials. In an exemplary embodiment, the base 12 and the dome-shaped top portion 30 may be made from a porous fabric that may allow water to pass through, while preventing particulates such as soil, sediment and debris from passing through. The forming rods 60*a*, 60*b* may be made of various materials, including but not limited to metals, woods, and plastics, that may aid in shaping the dome-shaped top portion 30 of the apparatus 10 of the present invention. In this example there are two rods used but more or less rods can be used to achieve the purpose of the invention. The rods may also be constructed as shown in the figures to naturally assume the position of the dome-shape or tent-shape, so that when placed in flat storing position the rods are under tension. Thus, when put in use in the field, the straps holding the rods together are released causing the rods to "pop" out to automatically form the dome-shape or tent-shape top portion. This optional feature enables the user to quickly and easily obtain the top portion shape by just releasing the closing straps 92 and letting the top portion "spring" into shape.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modification will provide the same result and fall within the spirit of the claimed invention. It is the intention, therefore, to limit the invention only as indicated by the scope of the claims.

What is claimed is:

1. A catch basin apparatus, comprising:

a catch basin having an opening configured to receive a grate, the grate having an upper surface;

a catch basin grate adapted to be positioned within said catch basin opening;

a base in association with said grate; and a top portion attached to said base and having an opening for receiving said grate, wherein a substantial portion of said top portion is adapted to be completely spaced apart from the upper surface of said grate when said grate is in said catch basin opening.

2. The apparatus of claim 1, wherein said top portion comprises:

a first wall, having a flat end, a semi-elliptical end, a right side and a left side;

a second wall, having a flat end, a semi-elliptical end, a right side and a left side;

a third wall, having a flat end, a semi-elliptical end, a right side and a left side;

a fourth wall, having a flat end, a semi-elliptical end, a right side and a left side;

wherein said right side of said semi-elliptical end of said first wall attaches to said left side of the semi-elliptical end of said second wall, said right side of said semi-elliptical end of said second wall attaches the said left side of said semi-elliptical end of said third wall, said right side of said semi-elliptical end of said third wall attaches to said left side of said semi-elliptical end of said fourth wall, said right side of said semi-elliptical end of said fourth wall attaches to said left side of said semi-elliptical end of said first wall.

3. The apparatus of claim 1, wherein said top portion is spring loaded to "pop" out when opened.

4. The apparatus of claim 1, wherein said top portion is dome-shaped.

5. The apparatus of claim 1, wherein said top portion is tent-shaped.

6. The apparatus of claim 1, wherein said top portion is of filter material.

7. The apparatus of claim 1, wherein at least one point of said top portion is of at least six inches above the upper surface of the grate.

8. The apparatus of claim 1, wherein at least one point of said top portion is at least one foot above the upper surface of the grate.

9. The apparatus of claim 1, wherein at least one point of said top portion is at least two feet above the upper surface of the grate.

10. The apparatus of claim 1, wherein said top portion has at least one wall of blocking material.

11. The apparatus of claim 1, wherein said base is a porous fabric material.

12. The apparatus of claim 1, wherein said base substantially encloses said grate.

13. The apparatus of claim 1, wherein said base is open below the grate and is pinched by the grate and the catch basin opening around a perimeter of said base.

14. The apparatus of claim 1, said filter further comprising:

a first forming rod and a second forming rod, whereby each forming rod attaches to said top portion by at least two securing loops, said forming rods having a first end and second end.

15. The apparatus of claim 14, whereby said first end of said first forming rod attaches to a first comer of said dome-shaped top portion, said second end of said first forming rod attaches to a third comer of said dome-shaped top portion, said first end of said second forming rod attaches to a second comer of said dome-shaped top portion, said second end of said second forming rod attaches to a fourth comer of said dome-shaped top portion.

16. The apparatus of claim 14, whereby said forming rods are semi-circular.

17. A catch basin apparatus, comprising:

a base, having a first side, a second side, a third side and a fourth side;

a top portion attached to said base and having an opening for receiving a grate, the grate having an upper surface, wherein said top portion is adapted to be spaced apart from the upper surface of said grate; and at least one positioning strap attached to a bottom of said base.

18. The apparatus of claim 17, wherein said top portion comprises:

a first wall, having a flat end, a semi-elliptical end, a right side and a left side;

a second wall, having a flat end, a semi-elliptical end, a right side and a left side;

a third wall, having a flat end, a semi-elliptical end, a right side and a left side;

a fourth wall, having a flat end, a semi-elliptical end, a right side and a left side;

wherein said right side of said semi-elliptical end of said first wall attaches to said left side of the semi-elliptical end of said second wall, said right side of said semi-elliptical end of said second wall attaches the said left side of said semi-elliptical end of said third wall, said right side of said semi-elliptical end of said third wall attaches to said left side of said semi-elliptical end of said fourth wall, said right side of said semi-elliptical end of said fourth wall attaches to said left side of said semi-elliptical end of said first wall.

19. The apparatus of claim 17, said filter further comprising:

a first forming rod and a second forming rod, whereby each forming rod attaches to said dome-shaped top portion by at least two securing loops, said forming rods having a first end and second end.

20. A method for filtering water flowing into a catch basin, said catch basin having an opening substantially covered by a generally planar grate having an upper surface, comprising:

providing an enclosure of filter fabric, said filter fabric being water-permeable, said filter fabric having a substantially dome-shaped top portion;

inserting said grate into said enclosure such that said dome-shaped top portion is spaced apart from the upper surface of said grate;

placing said grate, enclosed in said enclosure of filter fabric having a dome-shaped top portion; and repositioning said grate and filter over said catch basin opening;

wherein said enclosure of filter fabric filters solid materials substantially from entering said catch basin while said grate and said filter allow water to pass therethrough into said catch basin and wherein said filter is maintained in position by said grate.

* * * * *